US006708937B2

(12) United States Patent
Thurman

(10) Patent No.: US 6,708,937 B2
(45) Date of Patent: Mar. 23, 2004

(54) WALL MOUNT BRACKET FOR WELL TANKS

(76) Inventor: Todd Thurman, 1103 Overland Trail, Papillion, NE (US) 68046

( * ) Notice: Subject to any disclaimer, the term of this patent is extended or adjusted under 35 U.S.C. 154(b) by 0 days.

(21) Appl. No.: 10/378,962

(22) Filed: Mar. 4, 2003

(65) Prior Publication Data

US 2003/0173480 A1 Sep. 18, 2003

Related U.S. Application Data

(60) Provisional application No. 60/361,156, filed on Mar. 4, 2002.

(51) Int. Cl.[7] ..... F16M 11/00; F16L 3/22

(52) U.S. Cl. ..... 248/201; 248/68.1; 248/72

(58) Field of Search ..... 248/201, 200.1, 248/507, 49, 53, 65, 72, 73, 74.1, 317, 68.1, 57

(56) References Cited

U.S. PATENT DOCUMENTS

| | | | | | |
|---|---|---|---|---|---|
| 998,112 | A | * | 7/1911 | Murray | 174/158 R |
| 3,633,857 | A | * | 1/1972 | Logan | 248/62 |
| 3,903,671 | A | * | 9/1975 | Cuin et al. | 52/480 |
| 3,995,833 | A | * | 12/1976 | McLaughlin et al. | 256/59 |
| 4,662,590 | A | * | 5/1987 | Hungerford, Jr. | 248/72 |
| 4,960,253 | A | * | 10/1990 | Perrault et al. | 248/68.1 |
| 5,020,760 | A | * | 6/1991 | Mayr | 248/313 |
| 5,022,624 | A | * | 6/1991 | Hill | 248/274.1 |
| 5,050,824 | A | * | 9/1991 | Hubbard | 248/57 |
| 5,060,892 | A | * | 10/1991 | Dougherty | 248/57 |
| 5,133,094 | A | * | 7/1992 | Clarke, Jr. | 248/68.1 |
| 5,405,111 | A | * | 4/1995 | Medlin, Jr. | 248/205.1 |
| 5,593,115 | A | * | 1/1997 | Lewis | 248/68.1 |
| 6,299,080 | B1 | * | 10/2001 | Freemire | 241/46.02 |
| 6,402,096 | B1 | * | 6/2002 | Ismert et al. | 248/68.1 |
| 6,543,731 | B1 | * | 4/2003 | Mercier | 248/62 |

FOREIGN PATENT DOCUMENTS

| | | | |
|---|---|---|---|
| AU | 218515 | * | 3/1957 |
| DE | 1515385 | * | 6/1969 |
| DE | 2437092 | * | 2/1976 |
| FI | 37418 | * | 6/1969 |
| FR | 1322281 | * | 2/1963 |

* cited by examiner

*Primary Examiner*—Anita King
(74) *Attorney, Agent, or Firm*—Adam H. Jacobs

(57) ABSTRACT

A wall mount bracket for well tanks includes a wall-engaging base structure and at least one well tank bracket mounted on the base structure and extending generally parallel to a wall upon the wall-engaging base structure being mounted thereon. At least one pipe support bracket is mounted on the well tank bracket and extends generally perpendicular thereto. Finally, each of the at least one well tank bracket and the at least one pipe support bracket each further include a pair of spaced apart, generally parallel plates each having an inverted J-shaped lip formed thereon, the inverted J-shaped lip operative to be engaged by and releasably secure one of a tank mount and a pipe mount such that a well tank and associated piping is securely and releasably mounted on the wall mount bracket for well tanks.

7 Claims, 5 Drawing Sheets

WALL MOUNT BRACKET FOR WELL TANKS

CROSS-REFERENCE TO RELATED APPLICATION

This application claims priority to the filing date of a related provisional application serial No. 60/361,156 filed Mar. 4, 2002.

BACKGROUND OF THE INVENTION

1. Technical Field

The present invention is directed to wall mount brackets and, more particularly, to a wall-mount bracket for a well tank, which includes a base unit, a generally horizontally extending tank mounting bracket mounted on the base unit, and a generally vertical pipe mounting bracket extending generally perpendicular to the tank mount bracket for mounting a pipe thereto.

2. Description of the Prior Art

Water wells are used in many different parts of the world and the mechanisms used to bring ground water up to the surface are generally the same regardless of the exact specifications of the well. For example, a standard water well would include a pump placed at the bottom of the well hole and water pipe extending upwards therefrom to the surface to transfer the water upwards. The water pipe extends into a water well tank mounted inside the home or business, the water well tank acting as a reserve for water in case demand for the water increases beyond the pump capacity. Traditionally, water well tanks were large units having capacities in the area of forty to one hundred gallons and were unwieldy and difficult to handle during installation. Furthermore, due to their size, water well tanks would take up a lot of space in the house, space that could certainly be used for other purposes. There was therefore a need for a water well tank which was smaller yet fulfilled the functions of the larger well tanks.

This was made possible by the use of variable speed water pumps which could react to changes in water usage on the surface by increasing or decreasing their flow rate. Because the variable speed water pumps accommodated water demand changes with greater precision than the old on/off style pumps, the size of the water tank could be decreased as the size of the water reserve could be decreased. While this improvement resulted in smaller water well tanks, a new problem arose, specifically that the small size of the tanks meant that the manufacturers did not need to supply a stand or other support device with the well tank, leaving installers to fend for themselves. There is therefore a need for an easy to use mounting device for water well tanks which mounts the tank safely and efficiently in an out-of-the-way place.

Therefore, an object of the present invention is to provide an improved wall mount bracket for well tanks.

Another object of the present invention is to provide a wall mount bracket for well tanks which includes a base unit, a generally horizontally extending tank mounting bracket mounted on the base unit, and a generally vertical pipe mounting bracket extending generally perpendicular to the tank mount bracket for mounting a pipe thereto.

Another object of the present invention is to provide a wall mount bracket for well tanks which can be easily and quickly mounted to a wall surface.

Another object of the present invention is to provide a wall mount bracket for well tanks which can be modified for use with different types of well tanks and the pipe fittings connected thereto.

Another object of the present invention is to provide a wall mount bracket for well tanks which includes inverted J-shaped lips for releasably securing the well tank and pipe fittings on the wall surface.

Finally, an object of the present invention is to provide a wall mount bracket for well tanks which is relatively simple to manufacture and which is safe and durable in use.

SUMMARY OF THE INVENTION

The present invention provides a wall mount bracket for well tanks which includes a wall-engaging base structure and at least one well tank bracket mounted on the base structure and extending generally parallel to a wall upon the wall-engaging base structure being mounted thereon. At least one pipe support bracket is mounted on the well tank bracket and extends generally perpendicular thereto. Finally, each of the at least one well tank bracket and the at least one pipe support bracket each further include a pair of spaced apart, generally parallel plates each having an inverted J-shaped lip formed thereon, the inverted J-shaped lip operative to be engaged by and releasably secure one of a tank mount and a pipe mount such that a well tank and associated piping is securely and releasably mounted on the wall mount bracket for well tanks.

The wall mount bracket for well tanks as thus described clearly offers several advantages over those devices found in the prior art. The relatively simple design of the wall mount bracket for well tanks ensures that the unit will function properly for an extended lifetime. Also, because the present invention can include a number of different configurations or can also include varied bracket shapes for engagement by different tank and piping mounts, the present invention is usable in a virtually limitless number of ways. Furthermore, as the present invention will be relatively inexpensive to manufacture, it will be usable and purchasable by virtually all well installers. Finally, the wall mount bracket for well tanks of the present invention is safe and durable in use. The present invention thus provides a substantial improvement over those tank mount devices found in the prior art.

DESCRIPTION OF THE PREFERRED EMBODIMENT

Figure 1:
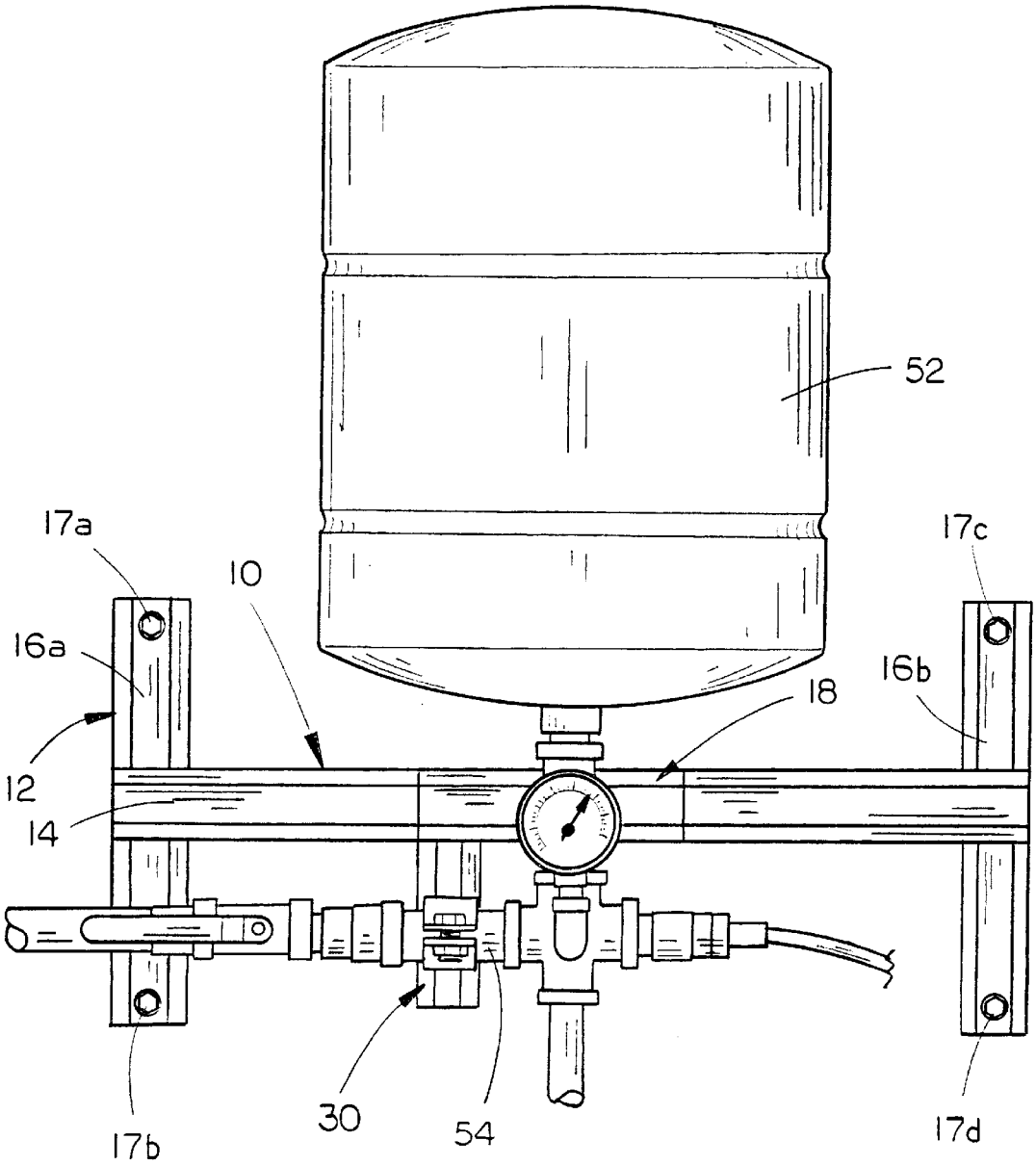
FIG. 1 is a top plan view of the well tank bracket of the present invention with a well tank mounted thereon.
Figure 2:
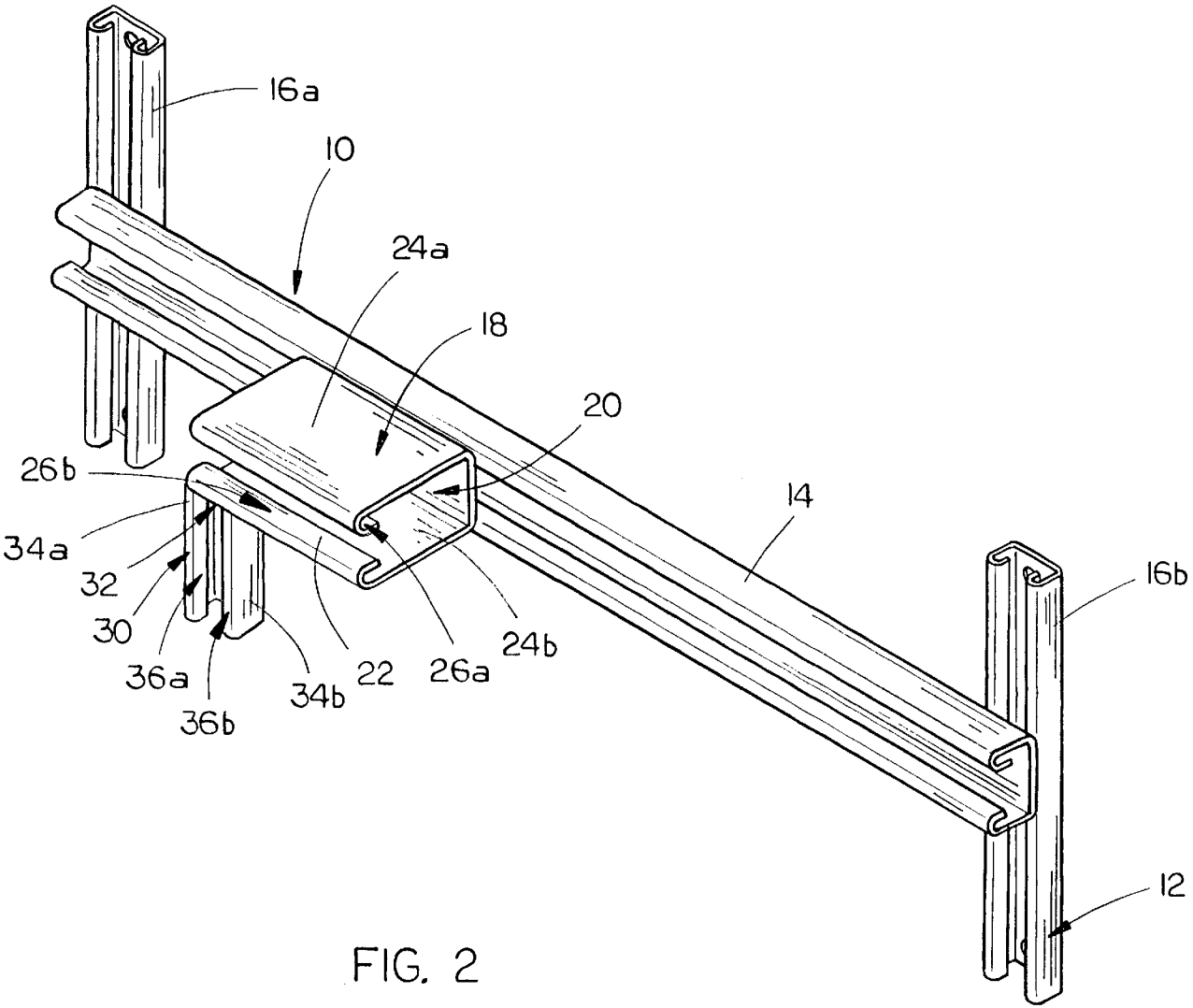
FIG. 2 is a perspective view of the present invention.
Figure 3:
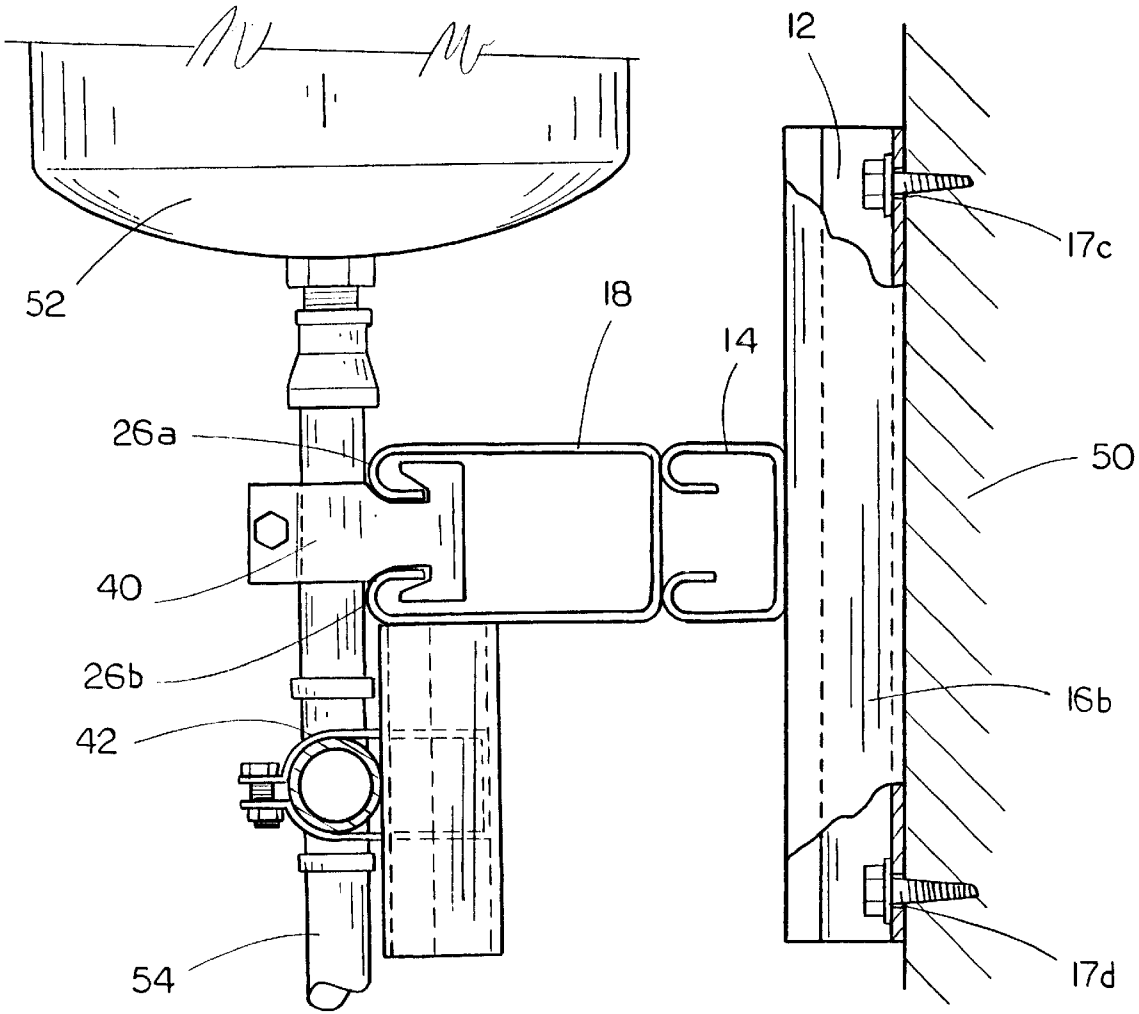
FIG. 3 is detail bottom elevational view of the elements of the present invention with a well tank mounted thereon.

The well tank bracket 10 of the present invention is shown best in FIGS. 1–3 as including a bracket base 12 having a longitudinally extended center beam 14 and a pair of wall-engaging struts 16*a* and 16*b* mounted on opposite ends of center beam 14 and extending generally perpendicular thereto. In the preferred embodiment, the entire well tank bracket 10 will be constructed of metal which is painted to resist corrosion, although it should be noted that many different types of construction materials may be used with the present invention so long as the invention performs substantially as described herein. Furthermore, the bracket base 12 may be constructed differently than as described herein so long as the intended function of mounting the well tank bracket 10 to a wall surface 50 is maintained.

Mounted on and extending generally parallel with center beam 14 is a tank support bracket 18 which, in the preferred embodiment, would have a generally U-shaped cross-sectional shape and would have a height of approximately 4 inches and a width of approximately one inch, as shown best in FIGS. 1–3. The lower end 20 of tank support bracket 18 would be mounted to the center beam 14 whereas the upper end 22 of tank support bracket 18 is open to receive the tank mount 40 to which the well tank 52 is mounted. In the preferred embodiment, tank support bracket 18 includes left and right upwardly extending plates 24*a* and 24*b*, each of which include an inverted J-shaped lip 26*a* and 26*b* formed adjacent to the upper ends 22 thereof, the inverted J-shaped lips 26*a* and 26*b* cooperating to retain the plate of tank mount 40 within the tank support bracket 18 yet simultaneously permitting lateral movement of the tank mount 40 within the tank support bracket 18 so that the precise alignment of the well tank bracket 10 on the wall surface 50 is not necessary in order to properly mount the well tank 52 on the well tank bracket 10.

Mounted on and extending perpendicularly downward from plate 24*b* of tank support bracket 18 is pipe support bracket 30 which, in the preferred embodiment, would be shaped similarly to tank support bracket 18 but would be of substantially less height, more on the order of approximately two inches. As shown in FIGS. 1–3, pipe support bracket 30 would preferably be welded to tank support bracket 18 and extend generally perpendicularly therefrom adjacent one end thereof, pipe support bracket 30 including an upper end 32 which is open to receive the pipe mount 42. Similarly to what was described in connection with tank support bracket 18, pipe support bracket 30 would include a pair of separated plates 34*a* and 34*b* extending generally parallel with one another, each of which includes an inverted J-shaped lip 36*a* and 36*b* adjacent to the upper ends 32 thereof. As described in connection with tank support bracket 18, these inverted J-shaped lips 36*a* and 36*b* cooperate to retain the pipe mount 42 within pipe support bracket 30 thus securely mounting the tank mount and pipe mount 40 and 42 on the well tank bracket 10.

The well tank bracket 10 of the present invention is used in the following manner. The approximate mounting location of the well tank bracket 10 is determined on the wall surface 50 and securement holes are drilled into the wall surface 50 by any standard method. The securement holes are aligned with the holes 17*a*, 17*b*, 17*c*, and 17*d* formed in the ends of wall-engaging struts 16*a* and 16*b*, and a plurality of bolts or other securement devices are extended through the holes 17*a–d* into the wall surface 50 to secure the well tank bracket 10 on the wall surface 50. Once the well tank bracket 10 is properly secured on the wall surface 50, the well tank 52 and piping 54 associated therewith may be mounted on the well tank bracket 10. The tank mount 40, which, in the preferred embodiment, may be either a generally T-shaped wedge fitted into the tank support bracket 18 as shown in FIG. 3 or alternatively is a clamp having a rearwardly extending bolt on which a plate is mounted, would be slid into the tank support bracket 18 from one end thereof and tightened to secure the well tank 52 on the tank support bracket 18. With the wedge clamp design, further tightening is not needed, but in the case of the alternative version of the tank mount, the bolt of tank mount 40 would be tightened thus drawing the plate towards the clamp until the tank mount 40 is securely fastened on the tank support bracket 18. Likewise, the pipe mount 42 may be of either type as described and would be slid into the pipe support bracket 30 and tightened in a similar manner as was described in connection with tank mount 40 such that upon completion of tightening of each of the tank mount 40 and pipe mount 42, the well tank 52 and piping 54 are securely mounted on the well tank bracket 10. For various other alignments of the well tank 52 and piping 54, the bracket 10 may be mounted after being rotated to the desired angle on the wall surface 50, such as being inverted to receive the well tank 52 and piping 54 from the opposite direction as shown in FIG. 3. Of course, the specific type of tank mount 40 and pipe mount 42 used in connection with the present invention is not critical so long as the well tank 52 and piping 54 connecting the well to the house supply is safely and securely mounted on the well tank bracket 10, various types of mounting devices being known in the art of plumbing installation.

Another example of the installation process is described as including the steps as follow:

1. In stud walls, find the studs within the wall and mark out a level spot to drill pilot holes.

1a. In concrete walls, mark a level spot and drill holes for wall anchors.

2. Screw the well tank bracket 10 to the wall through the holes 17*a–d* using wood or sheet metal screws, making sure the bracket 10 is level and secure to the wall.
3. Mount the brass tank tee and nipples to the bracket using the two 1" standard strut clamps.
4. Connect a WX101 or WX102 style well tank to the top of tank tee.
5. Connect a ¼"×2" brass nipple and elbow to the front of the tank tee.
6. Insert and connect a ¼"×2" pressure gauge on the ¼" brass elbow.
7. Connect a brass ball valve on the chosen side of the tank tee to go to the house supply.
8. Connect the pressure transducer to the tank tee opposite the house supply line.
9. Connect the well supply line into the bottom of the tank tee.
10. Hook up all electric connections.
11. Turn on the well pump and check for leaks.

Figure 4:
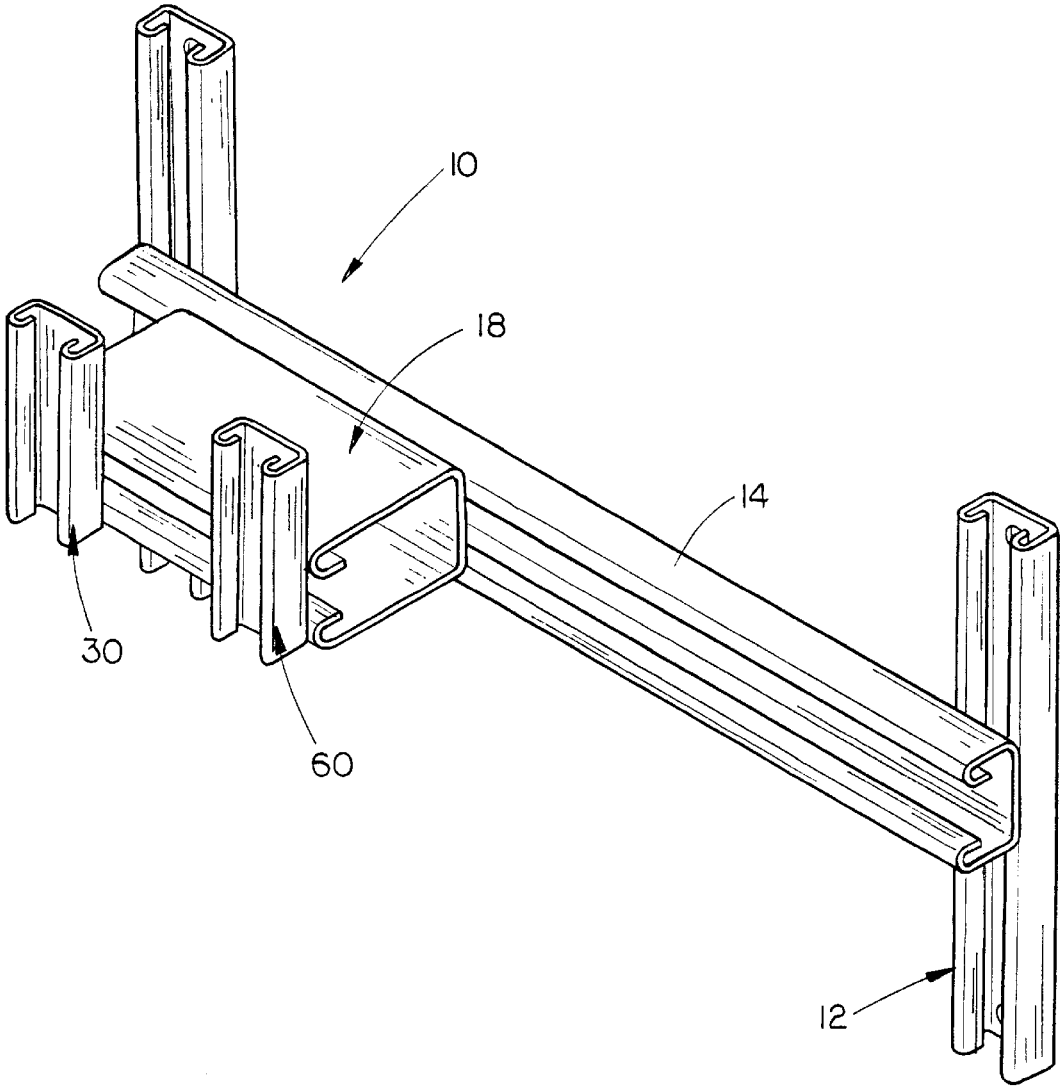
FIG. 4 is a perspective view of a second embodiment of the present invention supporting a somewhat different style of well tank and piping therefor.
Figure 5:
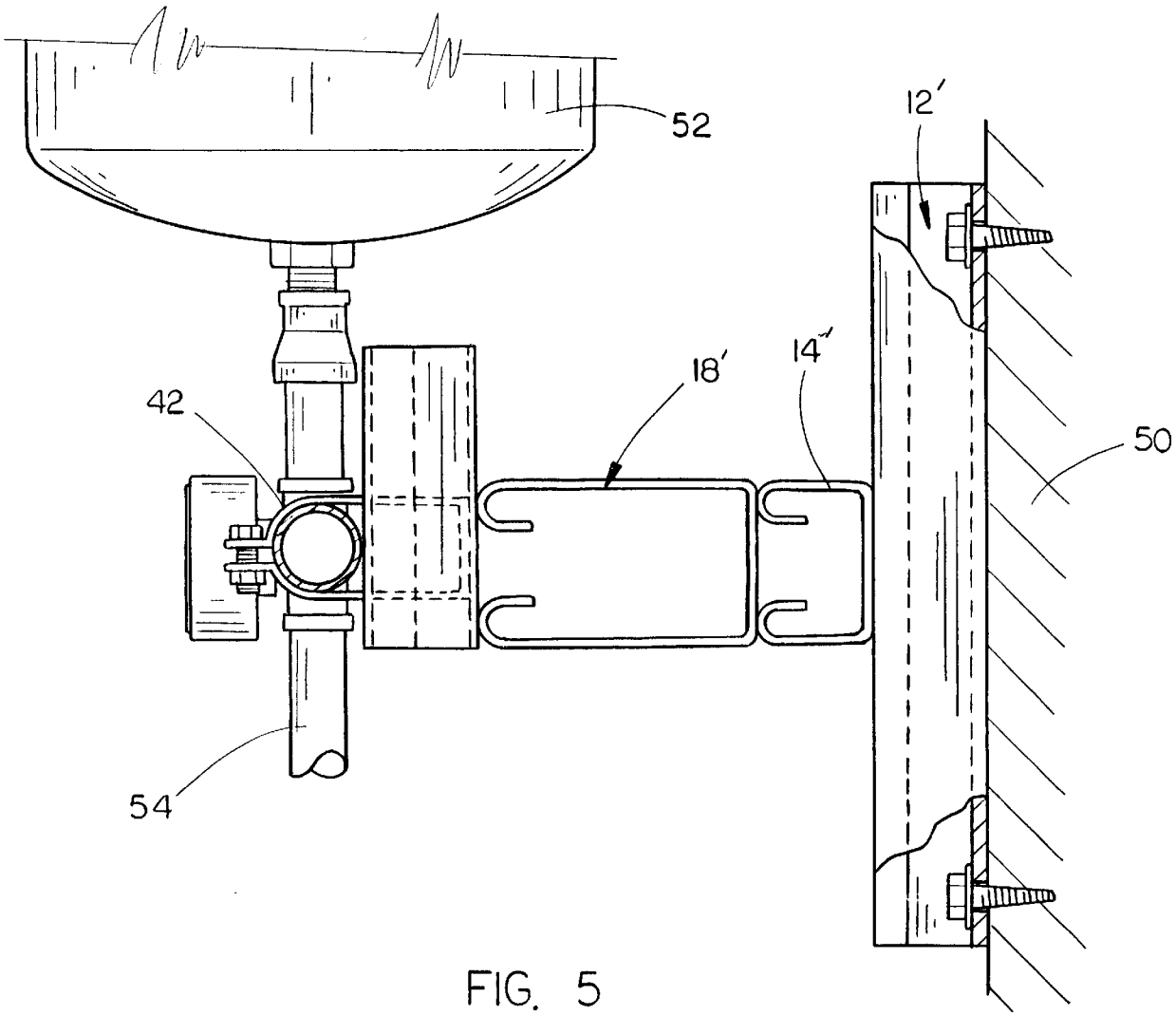
FIG. 5 is a detail bottom elevational view of the second embodiment of the present invention.

A second embodiment of the well tank bracket 10' of the present invention is shown in FIGS. 4 and 5 as including only a few significant modifications, but they are important for use in connection with certain types of well tanks. Specifically, the second embodiment includes a second pipe support bracket 60 mounted on and extending generally perpendicular to the tank support bracket 18' and spaced from and generally parallel with the first pipe support bracket 30'. In this embodiment, tank support bracket 18' does not directly support the well tank 52 as in the first embodiment, but does provide support for the first and second pipe support brackets 30' and 60. A pair of pipe mounts each connect to a respective one of the first and second pipe support brackets 30' and 60, as shown best in FIG. 4, and secure the well tank 52 and pipe fittings 54 on the well tank bracket 10' via the securement method described previously in connection with the embodiment of FIGS. 1–3. This embodiment is particularly useful for well tanks 52 and pipe fittings 54 which include a generally linear arrangement of elements thus decreasing the efficiency of use of the well tank bracket 10 of the first embodiment. Of course, it should be noted that the specific arrangement of tank support brackets 18 and pipe support brackets 30 may be modified or changed in accordance with the teachings of the present invention, so long as the intended functionality of the present invention is neither degraded nor destroyed.

Of course, it is to be further understood that numerous modifications, additions and substitutions may be made to the well tank bracket 10 of the present invention and method of installing same which fall within the intended broad scope of this description. For example, the exact size, shape and nature of the bracket base 12 may be modified so long as the bracket 10 may be securely affixed to a wall surface 50. Furthermore, the precise alignments and shapes of the tank support bracket 18 and pipe support bracket 30 may be modified or changed to accommodate various sized and shaped well tanks and piping for well tanks which are found in the industry. Also, although the present invention has been described as including inverted J-shaped lips (26*a* and 26*b* and 36*a* and 36*b*), it should be noted that various other shapes of lips may be used with the present invention so long as the lips cooperate with the clamps to secure the well tank 52 and piping 54 on the well tank bracket 10. Finally, the precise size, shape and construction materials used for the well tank bracket 10 may be modified and/or changed so long as the intended functionality of the present invention is maintained.

There has therefore been shown and described a well tank bracket which accomplishes at least all of its intended objectives.

I claim:

1. A wall mount bracket for well tanks comprising:

a wall-engaging base structure;

at least one well tank bracket mounted on said base structure and extending generally parallel to a wall upon said wall-engaging base structure being mounted thereon;

at least one pipe support bracket mounted on said well tank bracket and extending generally perpendicular thereto;

said at least one well tank bracket and said at least one pipe support bracket each further including a pair of spaced apart, generally parallel plates each having lip means formed thereon, said lip means operative to be engaged by and releasably secure at least one of a tank mount and a pipe mount such that a well tank is securely and releasably mounted on said wall mount bracket for well tanks.

2. The wall mount bracket for well tanks of claim 1 wherein said lip means of said at least one well tank bracket and said at least one pipe support bracket each are a generally inverted J-shape for engagement by at least one of a tank mount and a pipe mount.

3. The wall mount bracket for well tanks of claim 1 wherein said at least one pipe support bracket is mounted on a side of said at least one well tank bracket such that said lip means of said at least one well tank bracket and said at least one pipe support bracket are in generally coplanar alignment.

4. The wall mount bracket for well tanks of claim 1 comprising two of said pipe support brackets mounted at least one well tank bracket, said lip means of said two pipe support brackets in generally vertical coplanar alignment.

5. In combination:

a generally upright wall surface, a well tank, pipe fittings connected to said well tank and a tank mount and a pipe mount operative to mount said well tank and said pipe fittings; and a wall mount bracket for well tanks comprising:

a wall-engaging base structure adapted for mounting to said generally upright wall surface;

at least one well tank bracket mounted on said base structure and extending generally parallel to said wall surface upon said wall-engaging base structure being mounted on said wall surface;

at least one pipe support bracket mounted on said well tank bracket and extending generally perpendicular thereto;

said at least one well tank bracket and said at least one pipe support bracket each further including a pair of spaced apart, generally parallel plates each having an inverted generally J-shaped lip formed thereon, said inverted generally J-shaped lips on said at least one well tank bracket cooperating and operative to be engaged by and releasably secure said tank mount and said inverted generally J-shaped lips on said at least one pipe support bracket cooperating and operative to be engaged by and releasably secure said pipe mount such that said well tank and said pipe fittings are securely and releasably mounted on said wall mount bracket for well tanks and thus on said wall surface.

6. The wall mount bracket for well tanks of claim 5 wherein said tank mount is one of a generally T-shaped wedge and a clamp having a rearwardly extending bolt on which a plate is mounted, said tank mount operative to be slid into said at least one tank support bracket from one end thereof and tightened to secure said well tank on said tank support bracket, and said pipe mount is one of a generally T-shaped wedge and a clamp having a rearwardly extending bolt on which a plate is mounted, said pipe mount operative to be slid into said at least one pipe support bracket from one end thereof and tightened to secure said pipe fitting on said pipe support bracket such that upon completion of tightening of each of said tank mount and said pipe mount, said well tank and said pipe fitting are securely mounted on said wall mount bracket for well tanks.

7. A wall mount bracket for well tanks comprising:

a wall-engaging base structure;

at least one well tank bracket having mounted on said base structure;

at least two pipe support brackets mounted on said well tank bracket and each extending generally perpendicular thereto;

said at least one well tank bracket and said at least two pipe support bracket each further including a pair of spaced apart, generally parallel plates each having mount retaining lips formed thereon, said mount retaining lips operative to be engaged by and releasably secure at least one of a tank mount and a pipe mount on at least one of said at least one of said at least one well tank bracket and said at least two pipe support brackets such that a well tank is securely and releasably mounted on said wall mount bracket for well tanks.

* * * * *